US010580635B2

(12) United States Patent
Andrzejewski et al.

(10) Patent No.: US 10,580,635 B2
(45) Date of Patent: Mar. 3, 2020

(54) FLOATING MAGNET FOR A MASS SPECTROMETER

(71) Applicant: Luxembourg Institute Of Science And Technology (LIST), Esch-sur-Alzette (LU)

(72) Inventors: Roch Andrzejewski, Pabianice (PL); Rachid Barrahma, Soleuvre (LU); David Dowsett, Schuttrange (LU); Tom Wirtz, Grevenmacher (LU)

(73) Assignee: LUXEMBOURG INSTITUTE OF SCIENCE AND TECHNOLOGY (LIST), Luxembourg (LU)

( * ) Notice: Subject to any disclaimer, the term of this patent is extended or adjusted under 35 U.S.C. 154(b) by 0 days.

(21) Appl. No.: 16/076,385

(22) PCT Filed: Feb. 7, 2017

(86) PCT No.: PCT/EP2017/052635
§ 371 (c)(1),
(2) Date: Aug. 8, 2018

(87) PCT Pub. No.: WO2017/137390
PCT Pub. Date: Aug. 17, 2017

(65) Prior Publication Data

US 2019/0057853 A1 Feb. 21, 2019

(30) Foreign Application Priority Data

Feb. 8, 2016 (LU) ..... 92970

(51) Int. Cl.
*H01J 49/20* (2006.01)
*H01J 49/28* (2006.01)
*H01J 49/24* (2006.01)

(52) U.S. Cl.
CPC ..... *H01J 49/20* (2013.01); *H01J 49/24* (2013.01); *H01J 49/28* (2013.01)

(58) Field of Classification Search
CPC .. H01J 49/02; H01J 49/20; H01J 49/24; H01J 49/28; H01J 49/0013; H01J 49/0018; H01J 49/0022
See application file for complete search history.

(56) References Cited

U.S. PATENT DOCUMENTS 3,787,790 A * 1/1974 Hull ..... H01F 7/202 250/298
3,967,116 A * 6/1976 Geerk ..... H01J 49/30 250/298

(Continued)

FOREIGN PATENT DOCUMENTS

JP S58204684 A 11/1983
JP 60097605 A * 5/1985 ..... H01F 7/20

(Continued)

OTHER PUBLICATIONS

International Search Report for corresponding PCT/EP2017/052635 dated Apr. 12, 2017.

*Primary Examiner* — David E Smith
(74) *Attorney, Agent, or Firm* — Sandberg Phoenix & von Gontard PC

(57) ABSTRACT

An electromagnet assembly suitable for mass spectrometer comprising one yoke; and two pole pieces; the pole pieces being comprised in a vacuum chamber and being separated from each other by a pole piece gap defining a passage for the charged particles to be deflected; the yoke forming a bridge over the two pole pieces thus defining a magnetic circuit. The electromagnet assembly further comprises one electrical circuit for generating a magnetic flux in the magnetic circuit, the electrical circuit being included in the yoke. The electromagnet assembly is remarkable in that the (Continued)

pole pieces are electrically insulated from the electrical circuit and from the yoke by first electrical insulating means and are electrically insulated from the vacuum chamber.

17 Claims, 3 Drawing Sheets

(56) References Cited

U.S. PATENT DOCUMENTS

| | | | | | |
|---|---|---|---|---|---|
| 4,458,150 | A | * | 7/1984 | Matsuda | H01J 49/30<br>250/298 |
| 4,816,685 | A | * | 3/1989 | Lange | H01J 49/14<br>250/288 |
| 4,945,236 | A | * | 7/1990 | Mogami | H01J 49/0004<br>250/281 |
| 5,552,599 | A | * | 9/1996 | Giessmann | H01J 49/105<br>250/281 |

FOREIGN PATENT DOCUMENTS

| | | | |
|---|---|---|---|
| JP | S6097605 | A | 5/1985 |
| WO | 2005008719 | A2 | 1/2005 |
| WO | 2005098900 | A2 | 10/2005 |

* cited by examiner

FLOATING MAGNET FOR A MASS SPECTROMETER

CROSS-REFERENCE TO RELATED APPLICATIONS

The present invention is the US national stage under 35 U.S.C. § 371 of International Application No. PCT/EP2017/052635, which was filed on Feb. 7, 2017, and which claims the priority of application LU 92970 filed on Feb. 8, 2016, the content of which (text, drawings and claims) are incorporated here by reference in its entirety.

FIELD

The invention is directed to the field of magnetic spectrometers, in particular to the magnetic spectrometers using a floating design.

BACKGROUND

Secondary Ion Mass Spectrometry (SIMS) is an extremely powerful technique for analyzing surfaces due to its excellent sensitivity, high dynamic range, very high mass resolution, and ability to differentiate between isotopes. The sample to be analyzed is bombarded with an ion beam (i.e. the primary ion beam) in order to extract ions from the sample (i.e. the secondary ion beam). The secondary ion beam is then separated according to each individual ion's mass to charge ratio by passing it through a mass spectrometer. Many types of spectrometers exist including magnetic sectors, time of flight and quadrupoles.

In a conventional magnetic sector mass spectrometer, the ions are extracted by applying a high strength electric field between the sample and an extraction electrode, typically by applying a high voltage to the sample. Ions are then transported to the magnetic sector and deviated by the magnetic field before hitting the detector. In double focusing designs, an additional electrostatic sector is included. The radius of the electrostatic and the radius of magnetic sectors are calculated to produce an achromatic mass dispersion.

In a floating design mass spectrometer, the ions are extracted by applying a low strength electric field, then post-accelerated through the flight tube of the spectrometer in direction of the detector by applying a floating electric potential, namely an electric potential sufficient to allow the ions to reach the detector. The advantages of such design are that the extraction of secondary ions at low voltage avoids the disturbance of the primary ion beam allowing for higher lateral resolution analysis.

International patent application published WO 2005/008719 A2 relates to a mass spectrometer that switches the polarity of the pole pieces by using a permanent magnet. In this specific disclosure, the energy which is given to the ion beam is given at the extraction system and the magnet assembly is used only as a way to deviate the ions. The design of the magnet assembly with the rotating permanent magnet located outside of a vacuum chamber has for purpose to eliminate the need for rotary seals on feedthroughs into the vacuum chamber. However, this specific configuration prevents the possibility of applying a (high) voltage onto the magnet and prevents thus the floating of the whole mass spectrometer.

Japanese patent application numbered JPS58-204684 relates to an electromagnet device for a mass spectrometer. The electromagnet device of this document is designed for sustaining the application of any arbitrary (high) voltage (between −3 kV and +3 kV) on the pole pieces of the magnet. This renders the adoption of a low voltage ion source possible. However in this document the pole pieces are individually mounted on separate isolating supports, rendering accurate alignment of the pole pieces and precise definition of the pole piece gap difficult.

One of the most common solutions for magnetic sector mass spectrometers is to surround the vacuum chamber in which the ions travel by an electromagnet. The disadvantage of this approach is that a larger gap between the pole pieces is necessary to arrange the vacuum chamber in between the pole pieces of the magnet. With an increased gap, the homogeneity of the magnetic field inside the magnet decreases due to the increase of fringing magnetic fields regions. In addition, larger coils become necessary to induce the electromagnetic field, or, for a same coil size, more current needs to be injected. This can cause heating issues. A second solution consists in placing the electromagnet assembly inside the vacuum chamber. This requires a much bigger vacuum chamber and has the additional disadvantage that a cooling water circuit needs to be placed inside the vacuum chamber, increasing the complexity and the cost of the system. Placing an electromagnet inside a vacuum chamber therefore causes technical problems due to heat dissipation.

SUMMARY

The invention has for technical problem to alleviate at least one of the drawbacks present in the prior art.

The invention has for first object an electromagnet assembly suitable for mass spectrometer comprising one yoke and two pole pieces. The pole pieces are comprised in a vacuum chamber and are separated from each other by a pole piece gap defining a passage for the charged particles to be deflected, such as ions. The yoke bridges the two pole pieces, thus defining a magnetic circuit. The electromagnet assembly further comprises one electrical circuit for generating a magnetic flux in the magnetic circuit. The electromagnet assembly is remarkable in that the pole pieces are electrically insulated from the electrical circuit and from the yoke by first electrical insulating means and are electrically insulated from the vacuum chamber.

In various embodiments, the pole pieces are at an electrical potential which is comprised between 100 V and 10000 V or between −100V and −10000V.

In various embodiments, the two pole pieces are mounted to a first surface of metal plate with the first electrical insulating means on a second surface opposite to the first surface of the metal plate.

In various embodiments, the first electrical insulating means form a planar cross-section with a thickness which is comprised between 400 μm and 1000 μm, preferentially which is 500 μm.

In various embodiments, second electrical insulating means are mounted between the metal plate and the vacuum chamber.

In various embodiments, the second electrical insulator means form a planar cross-section with a thickness which is comprised between 20 mm and 40 mm, preferentially 28 mm.

In various embodiments, the electrical circuit comprises a coil which is wound around at least a part of the yoke.

In various embodiments, the pole piece gap measures less than 10 mm, preferentially less than 6 mm and more preferentially equal or less than 5 mm.

In various embodiments, the electromagnet assembly is further remarkable in that there is the presence of at least one magnetic shunt, which is orthogonal to the passage for the charged particles to be deflected and adjacent to the entrance pole face of the passage, wherein the at least one magnetic shunt further comprises an opening configured to let the charged particles pass.

In various embodiments, the angle $\alpha$, defined by the entrance pole face of the passage and a perpendicular segment of the main trajectory of the charged particles beam at the intersection of the main trajectory and the entrance pole face is comprised between 44° and 54°, preferentially between 46° and 52°, more preferentially the angle $\alpha$ is 49°.

In various embodiments, the angle $\gamma$, defined by the exit pole face of the passage and the perpendicular segment to the main trajectory of the charged particles beam at the intersection of the main trajectory and the exit pole face is comprised between −47.5° and −57.5°, preferentially between −49.5° and −55.5°, more preferentially the angle $\gamma$ is −52.5° with respect to the central ray.

In various embodiments, the angle $\beta$, defined by the total bending of the main trajectory of the charged particles beam is comprised between 65° and 100°, preferentially between 70° and 80°, more preferentially between 72° and 78°, even more preferentially the total bending angle is 75°.

The invention has for second object a use of an electromagnet assembly as deflecting means of a mass spectrometer. The electromagnet assembly for the use is remarkable in that the electromagnet is in accordance with the first object of the present invention.

The invention has for third object a mass spectrometer comprising an electromagnet assembly remarkable in that the electromagnet assembly is in accordance with the first object of the invention.

In various embodiments, the mass spectrometer further comprises one extraction system and is remarkable in that the extraction potential of the one extraction system is at a potential comprised between 50 V and 500 V.

The decoupling of energy of the secondary ions between the extraction region and the analysis region allows minimization of the disturbance of the primary ion beam, which enables a high lateral resolution analysis. It further results in a higher sensitivity analysis due to a more efficient transport of ions at high energy. As the influence of chromatic aberrations on the system is reduced, a higher mass resolution is also obtained by analysing the ions at high energy. As the pole pieces are inside the vacuum chamber, the pole gap is small which leads to a higher strength field for a given excitation of the coil. The size of the electromagnet is very small. It further greatly facilitates the manufacture of such a magnet assembly by allowing a precise alignment of the magnet with respect to each other and the other elements of the spectrometer, which is essential in order to obtain more homogenous electromagnetic fields in the surroundings of the pole pieces and therefore to optimize the deflecting of the particles to analyse, such as ions.

DRAWINGS

DETAILED DESCRIPTION

It is to be understood that the following features disclosed in relation with a particular embodiment can be combined with the features of other embodiments without any restrictions.

Figure 1:
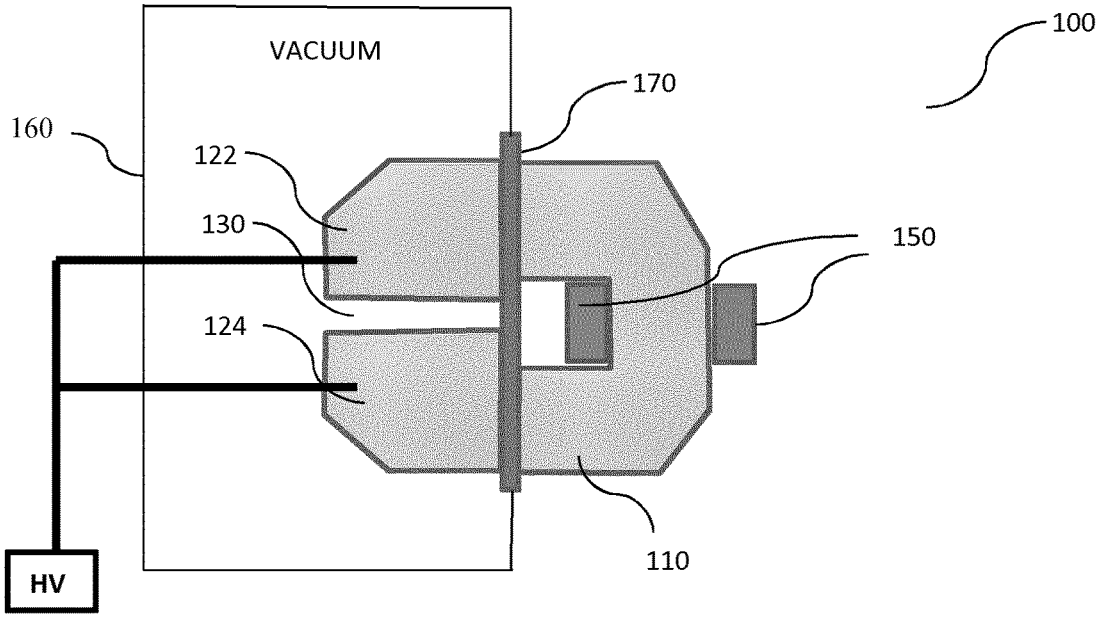
FIG. 1 is a schematic representation of the electromagnet assembly in accordance with various embodiments of the present invention.
Figure 2:
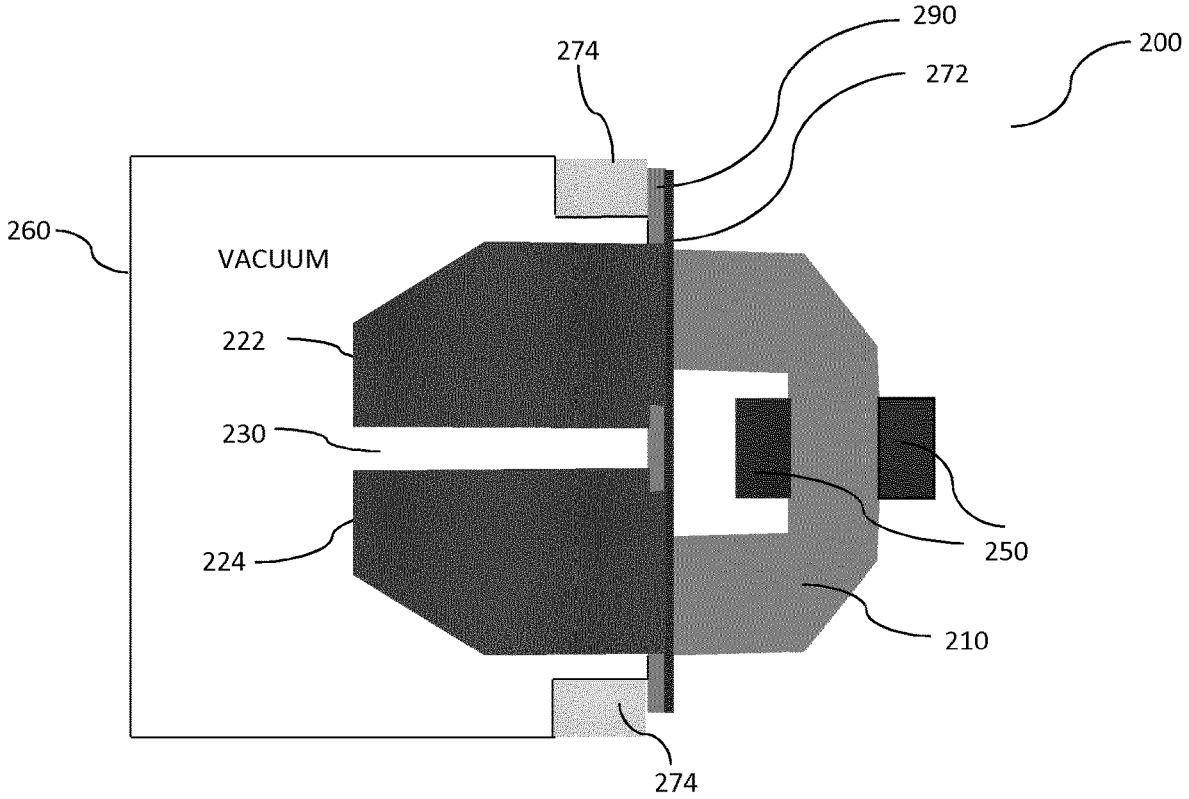
FIG. 2 is a cross-section of the electromagnet assembly in accordance with various embodiments of the present invention through its mid-plane.
Figure 4:
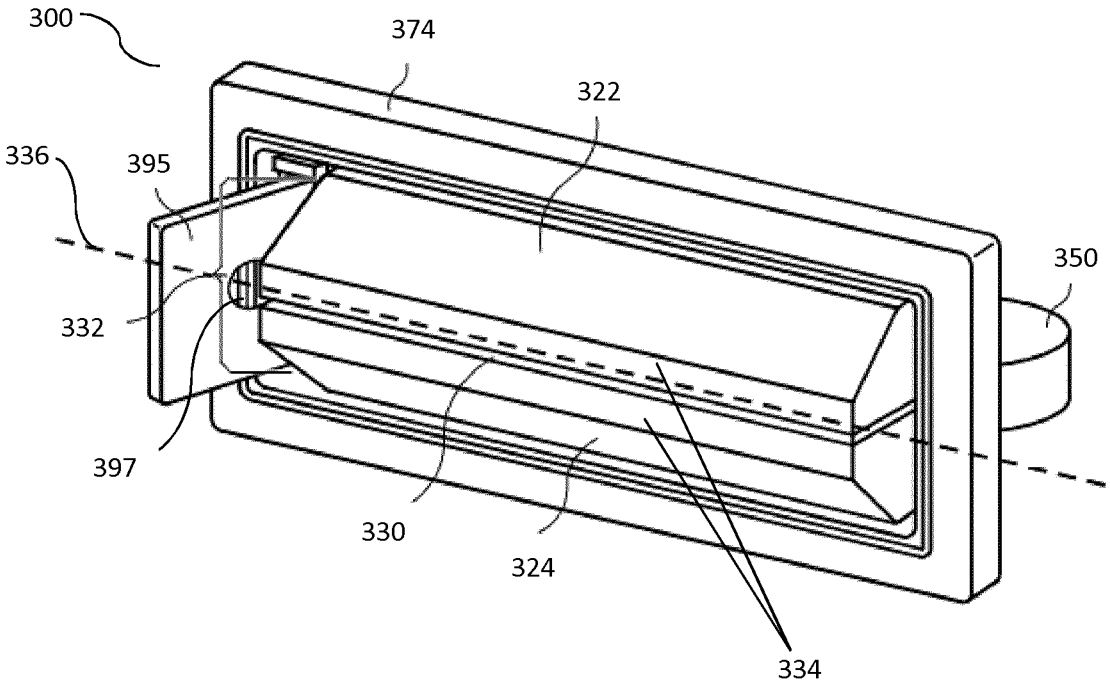
FIG. 4 is a view from the vacuum chamber of the electromagnet assembly in accordance with various embodiments of the present invention.
Figure 5:
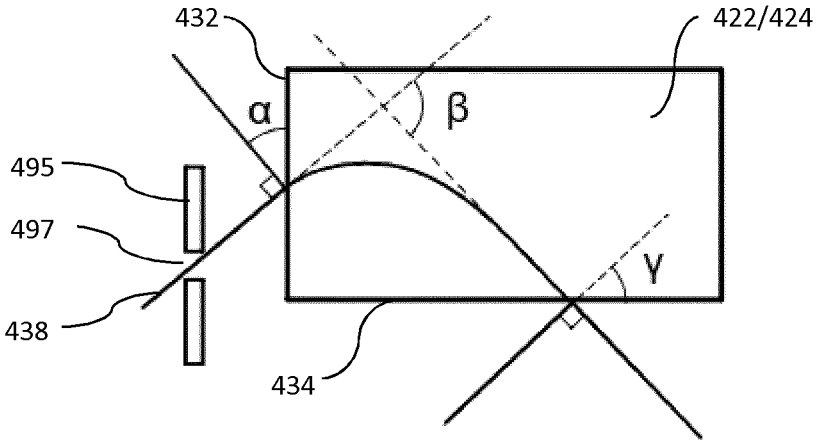
FIG. 5 is a scheme indicating the geometry of the electromagnet assembly including pole angle range in accordance with various embodiments of the present invention.

It is to be understood that the reference signs on FIG. 1 are incremented with the number 100. The reference signs for the same elements in the FIG. 2 are incremented with the number 200, in the FIG. 4 with the number 300 and in the FIG. 5 with the number 400.

In order to develop a mass spectrometer, in particular a SIMS mass spectrometer, which minimises the disturbance of the primary ion beam while the secondary ions are extracted, a floating design of the spectrometer must be envisioned. In practice, this means that the elements of the mass spectrometer that make the ion flight tube, including the pole pieces of the electromagnet, must be at an electric potential sufficient to promote the journey of the ions from the extraction system to the detector.

The SIMS mass spectrometer can be a double-focusing spectrometer.

A schematic representation of the electromagnet assembly 100 according to various embodiments of this invention is represented on FIG. 1.

The magnetic circuit is defined by a yoke with U section. The arms of the U section are directed towards two pole pieces. An electrical circuit is arranged with the yoke, in various instances in the base of the U section. As both pole pieces are connected to a high voltage (HV) source, an electrical insulator is present between the arms of the U section of the yoke and the pole pieces. The electrical insulator allows the magnetic field generated by the electrical circuit arranged with the yoke to develop its effect on the pole pieces and on the passage or gap defined between both pole pieces, through which the particles to analyse travel.

In this design, the yoke 110 and the electrical circuit 150, e.g. the coil, are separated from the pole pieces 122, 124 by electrical insulating means 170. The electrical insulating means 170 is adapted to ensure an efficient passage of the magnetic flux from the yoke to the pole pieces 122, 124. This enables the coil 150 and the yoke 110 to be outside the vacuum chamber 160 and to operate at ground potential while the pole pieces 122, 124 are situated inside the vacuum chamber 160 and operate at a generally arbitrary high voltage (HV).

The electrical insulating means 170 allow the application of a high voltage to the pole pieces 122, 124 without interfering with the other components of the mass spectrometer.

The yoke 110 and the electrical circuit 150 may be comprised in a non-illustrated chamber at atmospheric pressure.

The electrical insulating means 170 may comprise any materials known by the skilled person as electrical insulators. For example, composite polymer materials can be used.

The principle underlying this approach is that the magnetic flux is transmitted through the electrical insulating means 170, while the high voltage is not transmitted through the electrical insulating means 170.

In a second embodiment of the present invention, an electromagnet assembly 200 with a metal plate 290 is described. FIG. 2 represents a cross-section of the floating magnet (the high voltage source is not shown) through its mid-plane in accordance with that embodiment.

The pole pieces 222, 224 are mounted to the same side of a metal plate 290. On the opposite side of the metal plate 290, a first electrical insulator 272 is applied, which electrically insulates the pole pieces 222, 224 and the metal plate 290 from the yoke 210 and the coil 250. The first electrical insulator 272 thus electrically insulates a first region of the vacuum chamber which is located between the yoke 210 and the pole pieces 222, 224.

The metal plate 290 is made from a non-magnetic material, such as non-magnetic stainless steel.

The first electrical insulator 272 is in various instances made of polyether ether ketone or kapton.

The first electrical insulator 272 is thin, with a thickness comprised between 400 μm and 1000 μm, in various instances between 450 μm and 750 μm, for example of 500 μm. This relatively small thickness is sufficient to electrically insulate the pole pieces 222, 224 and the metal plate 290 from the yoke 210 and the coil 250. The small thickness is required to ensure an adequate transmission of the magnetic flux from the coil 250 to the pole pieces 222, 224.

In order to ensure a better electrical insulation of the pole pieces 222, 224 from the vacuum chamber 260, a second electrical insulator 274 is preferred.

The second electrical insulator 274 may have a planar cross-section of uniform thickness, the thickness being larger than the uniform thickness of the first electrical insulator 272.

The second electrical insulator 274 is applied in a second region of the vacuum chamber 260 which is not in contact with the pole pieces 222, 224.

The second electrical insulator 274 is applied between the metal plate 290 and the vacuum chamber 260, more precisely between the metal plate 290 and the closure of the vacuum chamber 260. In other words, the second electrical insulator 274 ensures an electrical insulation between the metal plate 290 and the vacuum chamber 260.

The second electrical insulator 274 is thicker than the first electrical insulator 272 since it is not located in the first region of the vacuum chamber, namely between the yoke and the pole pieces.

The second electrical insulator 274 has a thickness comprised between 20 mm and 40 mm, and can be one of 20 mm, 21 mm, 22 mm, 23 mm, 24 mm, 25 mm, 26 mm, 27 mm, 28 mm, 29 mm, 30 mm, 31 mm, 32 mm, 33 mm, 34 mm, 35 mm, 36 mm, 37 mm, 38 mm, 39 mm and 40 mm, in various instances 28 mm.

The metal plate 290 is part of the vacuum chamber 260, in various instances of one of its closures, and is electrically conductive to sustain a high voltage.

In various instances, sealing means are present between the second insulator 274 and the vacuum chamber 260. They can be shaped with different cross-sections, such as for example O-ring seals (also knowns as toric joint). They can be made of gold, indium, Viton® (a kind of rubber), or any other suitable material.

In various instances, the metal plate 290 can be vacuum-braised to the second electrical insulator 274. This removes the need for any sealing means between these two components.

Figure 3:
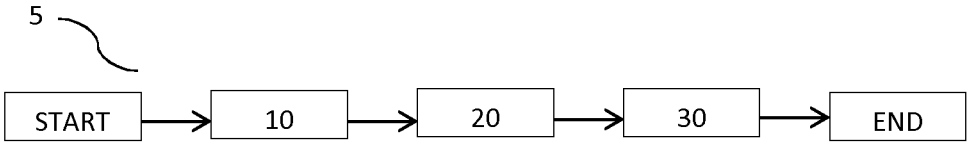
FIG. 3 is a work flow of method for producing an electromagnet assembly in accordance with various embodiments of the present invention.

In a third embodiment of the present invention, a method 5 for producing an electromagnet assembly 100, 200 is described. A workflow of the method is represented on FIG. 3.

The metal plate 290 allows the design of the magnet assembly to be manufactured with precision. Indeed, in the first step 10 of this process, the pole pieces are mounted, e.g. welded, on the same surface of a metal plate, namely on a first surface of the metal plate. In the second step 20 of the process, electrical insulating means are applied to the surface of the metal plate which is opposed to the first surface, namely, the electrical insulating means are applied to a second surface. In the third and final step 30 of the process, the metal plate designed with the pole piece on a first face and with the electrical insulating means on a second face opposite to the first face is assembled to a yoke, which includes an electrical circuit suitable for generating a magnetic flux in the magnetic circuit that has been defined by the assembling of the yoke and the two pole pieces. Such electrical circuit can be a coil which is wound around the yoke.

The insulation is further optimized by using for instance sealing means, such as O-ring seals, in order to lastingly fix the electrical insulating means between the vacuum chamber and the air chamber.

Another way to optimize the insulation is to vacuum-braise the metal plate with the second electrical insulator.

The welding of the pole pieces to the metal plate allows a precise alignment of the magnet with respect to the other elements comprised in the spectrometer, which is essential in order to obtain the most homogenous electromagnetic field in the surroundings of the pole pieces and therefore optimize the deflecting of the particles to analyse, such as ions. In order to implement the welding, a series of pins and slots in the post-machining of the pole pieces and the metal plate are established.

In general, the pole piece gap measures less than 10 mm, in various instances less than 6 mm.

The pole piece gap is in various instances of 5 mm, which allows the electromagnet assembly 100, 200 to be operated at magnetic fields of up to 0.8 T.

The pole piece gap can be reduced till 2 mm in order to sustain higher magnetic fields or require lower coil currents.

The final machining of the precise pole pieces shape is only done after the welding, which ensures the best possible mechanical tolerances and which avoids misalignment due to deformation and/or movement of the pole pieces during welding.

In order to improve the operation of charged particle analysers, the use of a field clamp, also called magnetic shunt 395 has been envisioned. The function of the magnetic shunt 395 is to aid in producing a sharp cut-off between the region of zero field externally to the electromagnet assembly and the region of the magnetic field within the electromagnet 300.

The magnetic shunt 395 is a planar cross-section which comprises an opening 397 to let the charged particles (ions) pass. The diameter of the opening 397 is about 5 mm.

The thickness of the planar cross-section of the magnetic shunt 395 is about 10 mm. In any case, the thickness of the planar cross-section of the magnetic shunt 395 should be enough to cut off the magnetic field.

The pole pieces are separated from each other by a pole piece gap defining a passage 330 for the charged particles, such as ions, to be deflected. The pole pieces are elongated in respect of one elongation axis 336 as indicated on FIG. 4, the passage being defined by the pole piece gap and following the same elongation axis 336.

The magnet further comprises one entrance pole face 332 and one exit pole face 334. The entrance pole face 332 and the exit pole face 334 are planar cross-sections which promote the homogeneity of the electromagnetic field. The exit pole face 334 is on the side facing the focal plane of the charged particles (ions) beam. In this configuration, the magnetic shunt 395 is fixed on the metal plate (not shown in FIG. 4), the magnetic shunt 395 is orthogonal to the passage or to the elongation axis 336 and is adjacent to the entrance pole face 332. The magnetic shunt 395 is parallel to the entrance face of the pole pieces. The magnetic shunt 395 is at floating potential.

The use of a floating spectrometer design allows high transmission of the secondary ion beam through the spectrometer. In the SIMS mass spectrometer comprising the floating magnet assembly as described above, the secondary ions are extracted at low voltage (in the range comprised between 50 V and 500 V) which thus minimises disturbance of the primary ion beam. The post acceleration is due to an accelerating potential which is in a range comprised between 1 kV and 10 kV.

This results in an improvement in focusing due to the higher accelerating voltages which further leads to the obtaining of a high mass resolution.

The parameters of the mass spectrometer are chosen to minimize the size of the magnet assembly and to have at the same time a large range regarding the mass detection. Among the parameters, the geometry of the setup can be adapted by adjusting the entrance pole face angle, the exit pole face angle and the total bending angle of the optic axis. Those various angles are represented on FIG. 5.

The optimum configuration of the mass spectrometer, in term of obtaining the best mass resolution when the floating electromagnet according to the described invention is used, is reached when one or all of the following three angles are respected:

- the angle $\alpha$, defined by the entrance pole face 432 of the passage and the perpendicular segment of the main trajectory 438 of the charged particles (ions) beam at the intersection of the main trajectory 438 and the entrance pole face 432. Usually, the angle $\alpha$ is comprised between 44° and 54°, in various instances between 46° and 52°. In one example, the angle $\alpha$ is 49°.
- the angle $\gamma$, defined by the exit pole face 434 of the passage and the perpendicular segment to the main trajectory 438 of the charged particles (ions) beam at the intersection of the main trajectory 438 and the exit pole face 434. Usually, the angle $\gamma$ is comprised between −47.5° and −57.5°, in various instances between −49.5° and −55.5°. In one example, the angle $\gamma$ is −52.5°.
- the angle $\beta$, defined by the total bending of the main trajectory 438 of the charged particles (ions) beam. Usually, the angle $\beta$ is comprised between 65° and 100°, in various instances between 70° and 80°, for example between 72° and 78°. In one example, the angle $\beta$ is 75°.

The pole pieces of the mass spectrometer can be of different shapes generally used by the person skilled in the art. Parts of the magnet for correcting fringe electromagnetic field and shielding therefore the optical system of the mass spectrometer can also be present.

The invention claimed is:

1. An electromagnet assembly for secondary ion mass spectrometer, said assembly comprising:

one yoke;

two pole pieces;

the pole pieces being comprised in a vacuum chamber and being separated from each other by a pole piece gap defining a passage for the charged particles to be deflected;

the yoke bridging the two pole pieces, and defining a magnetic circuit; and one electrical circuit for generating a magnetic flux in the magnetic circuit;

wherein the pole pieces are electrically insulated from the electrical circuit and from the yoke by a first common planar electrical insulating element extending transversally to the pole piece gap and are electrically insulated from the vacuum chamber.

2. The electromagnet assembly according to claim 1, wherein the pole pieces are at an electrical potential that is comprised between one of 100 V and 10000 V or −100 V and −10000 V.

3. The electromagnet assembly according to claim 1, wherein the two pole pieces are mounted to a first surface of a metal plate with the first electrical insulating element on a second surface opposite to the first surface of the metal plate.

4. The electromagnet assembly according to claim 1, wherein the first electrical insulating element forms a planar cross-section with a thickness that is comprised between 400 μm and 1000 μm.

5. The electromagnet assembly according to claim 3, wherein a second electrical insulating element is mounted between the metal plate and the vacuum chamber.

6. The electromagnet assembly according to claim 3, wherein a second electrical insulating element is mounted between the metal plate and the vacuum chamber.

7. The electromagnet assembly according to claim 5, wherein the second electrical insulating element forms a planar cross-section with a thickness that is comprised between 20 mm and 40 mm.

8. The electromagnet assembly according to claim 6, wherein the second electrical insulating element forms a planar cross-section with a thickness that is comprised between 20 mm and 40 mm.

9. The electromagnet assembly according to claim 1, wherein the electrical circuit comprises a coil that is wound around at least a part of the yoke.

10. The electromagnet assembly according to claim 1, wherein the pole piece gap measures less than 10 mm.

11. The electromagnet assembly according to claim 1, wherein the electromagnet assembly further comprises at least one magnetic shunt, that is orthogonal to the passage for the charged particles to be deflected and adjacent to the entrance pole face of the passage, wherein the at least one magnetic shunt further comprises an opening configured to let the charged particles pass.

12. The electromagnet assembly according to claim 1, wherein the angle $\alpha$, defined by the entrance pole face of the passage and a perpendicular segment of the main trajectory of the charged particles beam at the intersection of the main trajectory and the entrance pole face is comprised between 44° and 54°.

13. The electromagnet assembly according to claim 1, wherein the angle $\gamma$, defined by the exit pole face of the passage and the perpendicular segment to the main trajectory of the charged particles beam at the intersection of the main trajectory and the exit pole face is comprised between −47.5° and −57.5°.

14. The electromagnet assembly according to claim 1, wherein angle β, defined by the total bending of the main trajectory of the charged particles beam is comprised between 65° and 100°.

15. A secondary ion mass spectrometer comprising an electromagnet assembly for secondary ion mass spectrometer, said assembly comprising one yoke;

two pole pieces;

the pole pieces being comprised in a vacuum chamber and being separated from each other by a pole piece gap defining a passage for the charged particles to be deflected;

the yoke bridging the two pole pieces, thus defining a magnetic circuit; and one electrical circuit for generating a magnetic flux in the magnetic circuit;

wherein the pole pieces are electrically insulated from the electrical circuit and from the yoke by a first common planar electrical insulating element extending transversally to the pole piece gap and are electrically insulated from the vacuum chamber.

16. Secondary ion mass spectrometer according to claim 15, further comprising one extraction system, wherein the extraction potential of the one extraction system is at a potential comprised between 50 V and 500 V.

17. An electromagnet assembly for secondary ion mass spectrometer, said assembly comprising:

one yoke;

two pole pieces;

the pole pieces being comprised in a vacuum chamber and being separated from each other by a pole piece gap defining a passage for the charged particles to be deflected;

the yoke bridging the two pole pieces, and defining a magnetic circuit; and one electrical circuit for generating a magnetic flux in the magnetic circuit;

wherein the pole pieces are electrically insulated from the electrical circuit and from the yoke by a first electrical insulating element and are electrically insulated from the vacuum chamber; and wherein a second electrical insulating element is mounted between a metal plate to which the pole pieces are mounted and the vacuum chamber.

* * * * *